US010798810B2

(12) United States Patent
Sortais

(10) Patent No.: US 10,798,810 B2
(45) Date of Patent: Oct. 6, 2020

(54) PLASMA SOURCE

(71) Applicant: Polygon Physics, Meylan (FR)

(72) Inventor: Pascal Sortais, Meylan (FR)

(73) Assignee: Polygon Physics, Meylan (FR)

( * ) Notice: Subject to any disclaimer, the term of this patent is extended or adjusted under 35 U.S.C. 154(b) by 0 days.

(21) Appl. No.: 16/480,063

(22) PCT Filed: Dec. 21, 2017

(86) PCT No.: PCT/FR2017/053798

§ 371 (c)(1),
(2) Date: Jul. 23, 2019

(87) PCT Pub. No.: WO2018/142036

PCT Pub. Date: Aug. 9, 2018

(65) Prior Publication Data

US 2019/0394866 A1 Dec. 26, 2019

(30) Foreign Application Priority Data

Feb. 6, 2017 (FR) ..... 17 50978

(51) Int. Cl.
*H05H 1/46* (2006.01)
*H01J 27/16* (2006.01)

(52) U.S. Cl.
CPC ..... *H05H 1/46* (2013.01); *H01J 27/16* (2013.01); *H01J 2237/0817* (2013.01); *H05H 2001/463* (2013.01); *H05H 2001/466* (2013.01)

(58) Field of Classification Search
CPC ..... H05H 1/46; H05H 2001/463; H05H 2001/466; H01J 27/16; H01J 2237/0817; H01J 37/32192; H05B 6/72; F02P 9/007; F02P 23/045
See application file for complete search history.

(56) References Cited

U.S. PATENT DOCUMENTS

| | | | | |
|---|---|---|---|---|
| 4,609,808 | A * | 9/1986 | Bloyet | H05H 1/46 219/121.36 |
| 5,361,737 | A | 11/1994 | Smith et al. | |
| 5,961,772 | A * | 10/1999 | Selwyn | H01J 37/32192 118/723 ER |
| 7,103,460 | B1 * | 9/2006 | Breed | B60C 23/0408 701/29.1 |
| 8,664,862 | B2 * | 3/2014 | Sortais | H01J 27/16 315/111.41 |
| 2007/0095823 | A1 * | 5/2007 | Sedlmayr | H05B 6/806 219/688 |

FOREIGN PATENT DOCUMENTS

| | | | |
|---|---|---|---|
| FR | 2480552 | A1 | 10/1981 |
| WO | 9835379 | A1 | 8/1998 |

* cited by examiner

*Primary Examiner* — Haissa Philogene
(74) *Attorney, Agent, or Firm* — The Noblitt Group, PLLC

(57) ABSTRACT

The invention concerns a plasma source including a quarter wave antenna (204) located in a cylindrical enclosure (202) provided with an opening (208) opposite the end of the antenna (204). The diameter (d) of the antenna (204) is in the range from one third to one quarter of the inner diameter ($d_1$) of the enclosure (202). The distance (l) between the end of the antenna (204) and the opening (208) is in the range from ⅔ to ⅚ of the diameter (d) of the antenna (204).

8 Claims, 3 Drawing Sheets

PLASMA SOURCE

CROSS-REFERENCE TO RELATED APPLICATIONS

The present patent application claims priority to PCT application number PCT/FR2017/053798, filed Dec. 21, 2017, which claims the benefit of French patent application number FR17/50978, filed Feb. 6, 2017, and incorporates the disclosure of such applications by reference. To the extent that the present disclosure conflicts with any referenced application, however, the present disclosure is to be given priority.

BACKGROUND

The present invention concerns a gaseous plasma source and more specifically a source in which the plasma is obtained by interaction between a high-frequency electromagnetic radiation and a low-pressure gas.

DISCUSSION OF THE RELATED ART

It is known that by applying an electromagnetic radiation to a low-pressure gas, the gas is capable of ionizing and of forming a plasma in an area where the high-frequency electromagnetic field has a sufficient intensity.

FIG. 1 appended hereto is a copy of FIG. 1 of Japanese patent application published under number JPH09245658, describing a plasma source. Only certain elements of the drawing will be described hereafter. Reference will be made hereafter to the Japanese patent application for more complete explanations. The plasma source shown in this drawing comprises a plasma chamber 1 having a quarter wave antenna 6 arranged therein. Antenna 6 is isolated from the enclosure of plasma chamber 1 at its base by an isolator 2. The free end of antenna 6 is located opposite a perforated electrode 8. An input 4 allows gas to be introduced into the low-pressure enclosure of chamber 1. The antenna is excited by a high-frequency electromagnetic field and a plasma 5 foil's in chamber 1 at the locations where the electromagnetic field is maximum, as indicated by a cloud of points. Permanent magnets 3 are arranged around the enclosure of plasma chamber 1, to confine the plasma. Charges of the plasma are capable of being extracted through an opening or extraction grid 14.

In paragraph [0020] of Japanese patent application JPH09245658, antenna 6 is described as having a lifetime from two to three hours, which is imputed to the fact that antenna 6 is submitted to a spraying, as well as the walls of enclosure 1. It is specified that it is thus necessary to regularly change antenna 6 and to clean plasma chamber 1. Accordingly, it is necessary to regularly take out the plasma source from the vacuum enclosure where it is used, which causes relatively long maintenance and vacuum restoration operations.

It would be desirable to have a plasma source having a lifetime longer than that described in Japanese patent application JPH09245658.

SUMMARY

Thus, an embodiment provides a plasma source comprising a quarter wave antenna located in a cylindrical enclosure provided with an opening opposite the end of the antenna, wherein: the diameter of the antenna is in the range from one third to one quarter of the inner diameter of the enclosure, the distance between the end of the antenna and the opening is in the range from ⅔ to ⅚ of the diameter of the antenna.

According to an embodiment, the inner diameter of the enclosure is in the order of 10 mm.

According to an embodiment, the inner diameter of the enclosure is 10 mm, the diameter of the antenna is in the range from 2.5 to 3.3 mm, and the distance between the end of the antenna and the opening is in the range from 1.5 to 5.5 mm.

According to an embodiment, the opening is a circular opening having a diameter in the range from 1 μm to the inner diameter of the enclosure.

According to an embodiment, the opening is an extraction grid.

According to an embodiment, the excitation frequency of the antenna is 2.45 GHz.

An embodiment provides an extensive plasma source comprising an assembly of plasma sources such as those previously described, arranged side by side.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION

Figure 1:
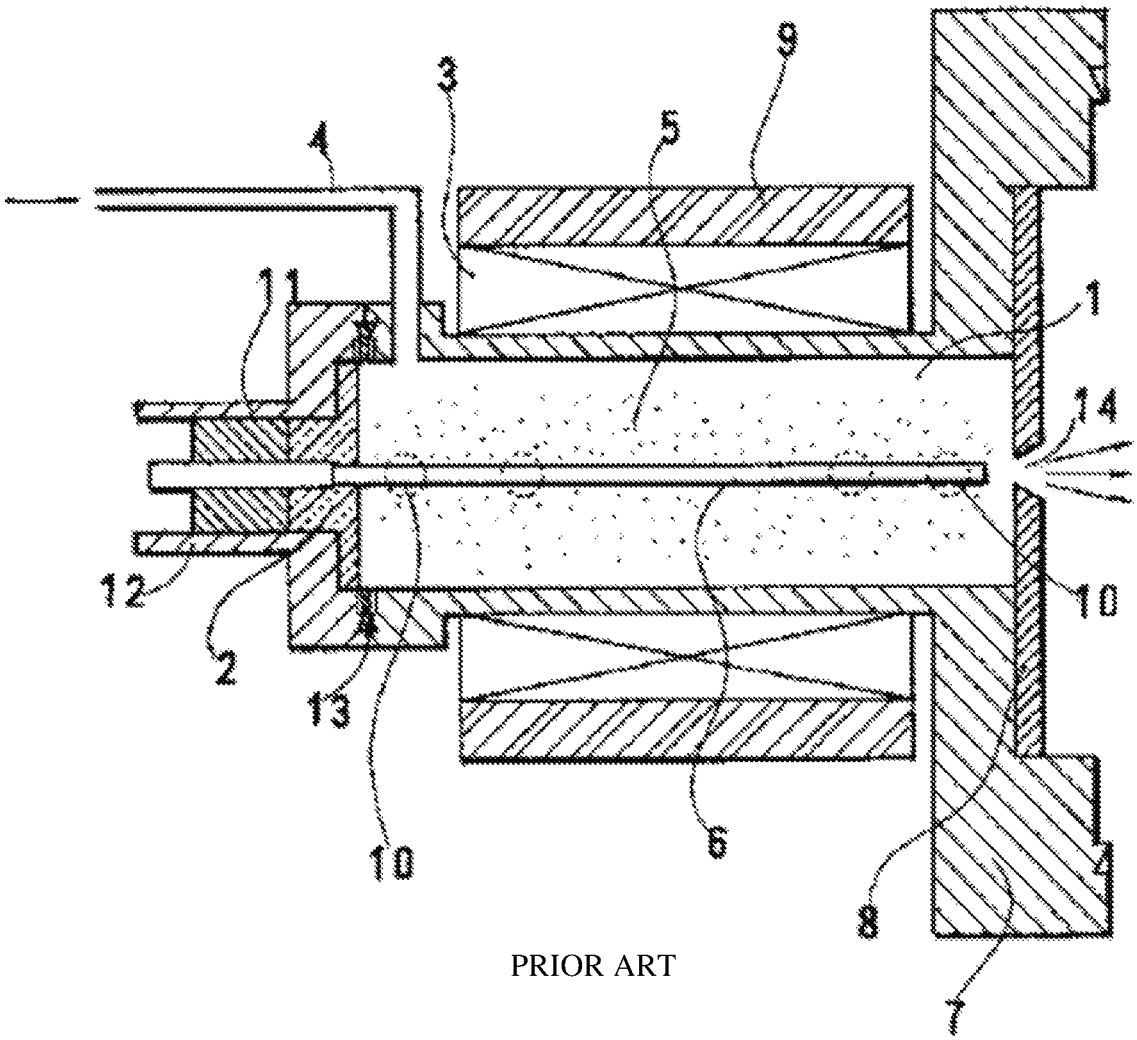
PRIOR ART Fig 1
FIG. 1, previously described, is a cross-section view of a plasma source and is a copy of FIG. 1 of patent application JPH09245658.

The same elements have been designated with the same reference numerals in the different drawings. For clarity, only those steps and elements which are useful to the understanding of the described embodiments have been shown and are detailed. In particular, the plasma source elements surrounding the plasma chamber, such as, in particular, a gas inlet, permanent magnets, connections of high-frequency signals and extraction electrodes, are not shown.

Figure 2C:
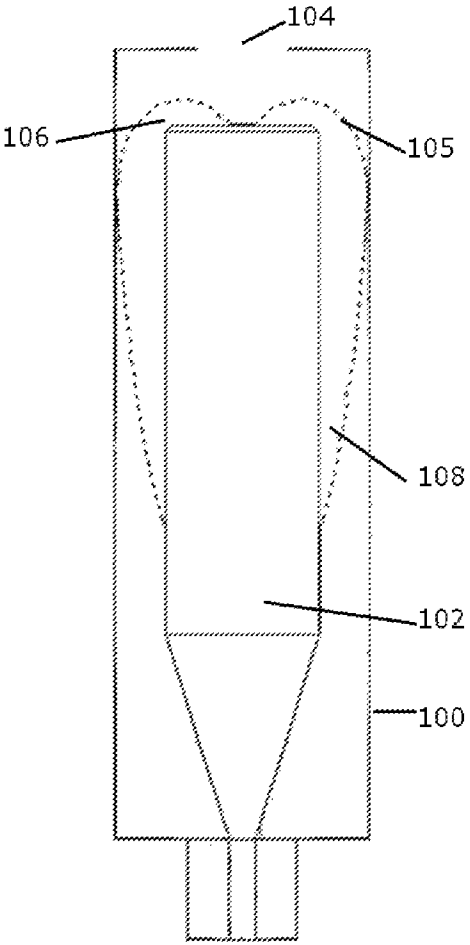
FIGS. 2A to 2C show plasma chambers provided with antennas having different diameters.
Figure 2B:
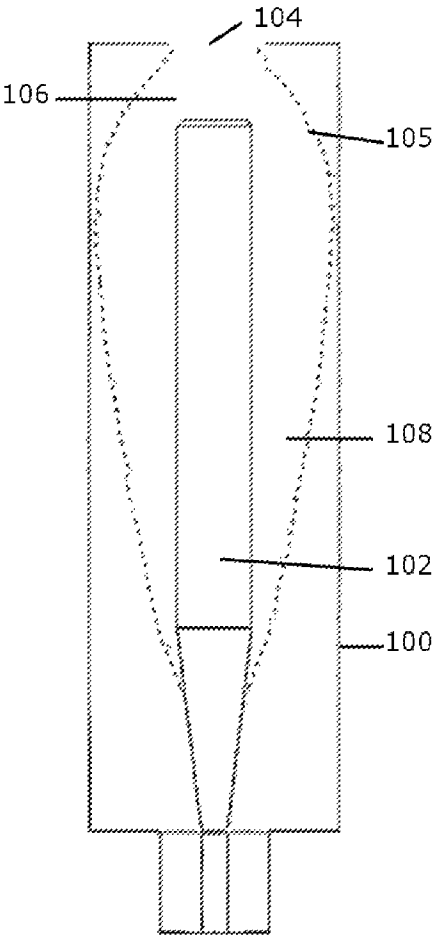
Figure 2A:
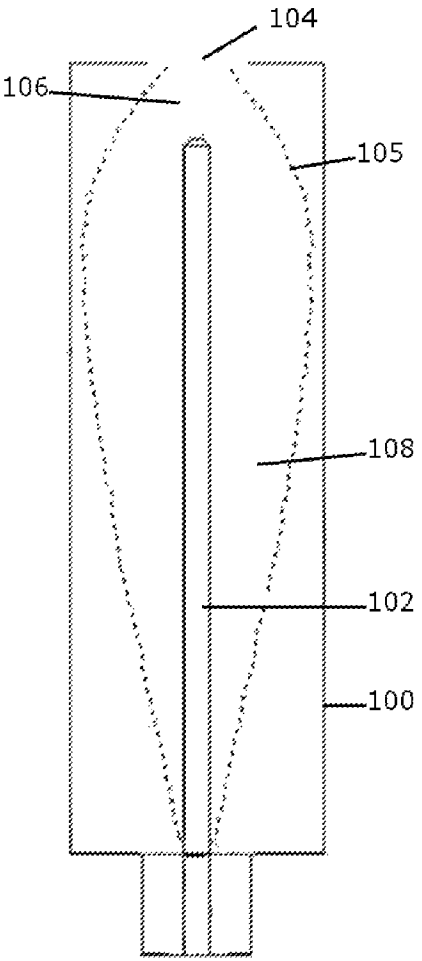

The terms "approximately", "substantially", and "in the order of" are used herein to designate a tolerance of plus or minus 10%, preferably of plus or minus 5%, of the value in question FIGS. 2A to 2C are cross-section views of cylindrical plasma chambers 100, all identical, having quarter wave antennas 102 of different diameters arranged therein. Quarter wave antenna means an antenna having a length approximately equal to one quarter of the wavelength of the excitation signal of the antenna.

The antennas of FIGS. 2A, 2B, and 2C have respective diameters of 1, 3, and 6 mm. Each plasma chamber 100 comprises an opening or extraction grid 104 through which ions of the plasma may be extracted.

In each enclosure 100, a surface 105 delimits a plasma-forming region. Such a plasma-forming region corresponds to the area surrounding the antenna where the electromagnetic field has a sufficiently high value to enable to form the plasma. This value may for example be in the order of $10^4$ V/m.

The inventors consider a first region 106 in each plasma-forming region. Region 106 is located on the side of opening or extraction grid 104. Region 106, here called useful region, contains a plasma which will be called useful plasma, that is, the plasma from which ions can be extracted to form an ion source.

The inventors further consider a second region 108 in each plasma forming region. Region 108 is located around antenna 102 along at least part of its length. Region 108, here called useless region, contains a plasma which will be called useless plasma. The useless plasma cannot be extracted from the plasma source, and thus has no useful role but appears to be the cause of the degradation of antenna 102 described in patent application JPH09245658.

The inventors have thus attempted to maximize the useful plasma volume while decreasing the useless plasma volume. To achieve this, the inventors have studied the incidence of the diameter of antenna 102 of a plasma chamber 100 on such useful and useless plasma regions.

In FIGS. 2A or 2C, as well as in the following drawings, plasma chambers 100 having an inner diameter equal to 10 mm are considered as an example.

In FIG. 2A, antenna 102 has a 1-mm diameter. This corresponds to the dimensions of the antenna and of the plasma chamber illustrated in the above-mentioned Japanese patent application.

In FIG. 2B, antenna 102 has a 3-mm diameter. Useless region 108 has a smaller volume than in the case of FIG. 2A, which results in a decreased degradation. Useless region 106 however keeps a similar volume.

In FIG. 2C, antenna 102 has a 6-mm diameter. Useless region 108 has a further decreased volume. However, the volume of useless region 106 is also decreased.

Figure 3A:
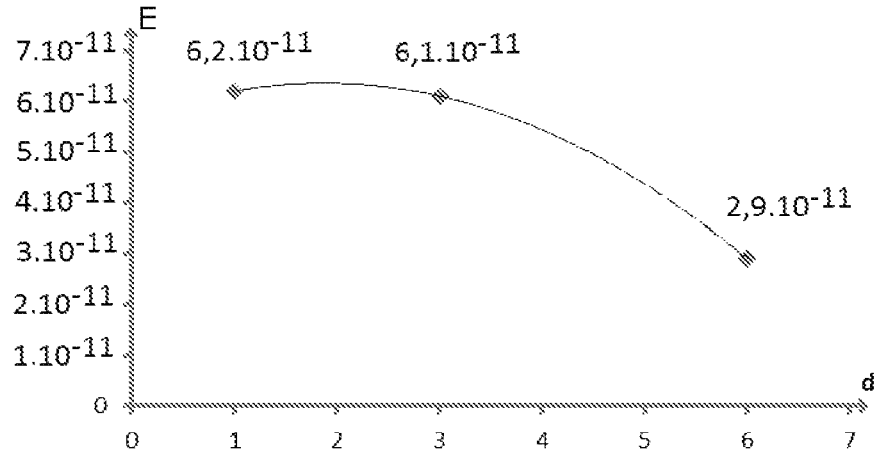
FIGS. 3A and 3B are diagrams showing the average energy E radiated by the antenna in various areas according to diameter d of the antenna.
Figure 3B:
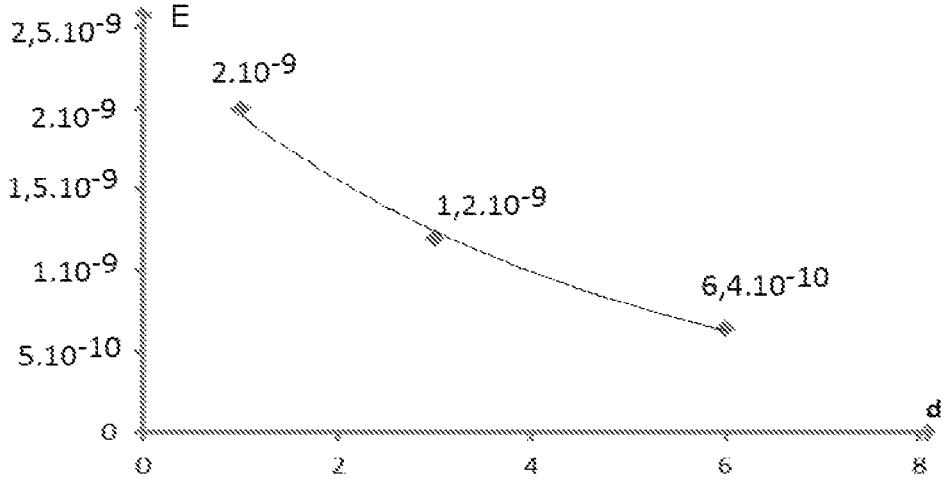

FIGS. 3A and 3B are diagrams respectively showing the energy E stored in useful region 106 and in useless region 108, according to diameter d of antenna 102, for a same radiated power having a 5-W intensity at a 2.45-GHz frequency.

In FIG. 3A, is can be observed that the energy E stored in useful region 106, for diameters d of antenna 102 in the range from 1 to 3 mm, is approximately constant, and close to $6.10^{-11}$ J. It can also be observed that, for diameters d in the range from 3 to 6 mm, the energy E stored in useful region 106 markedly decreases to reach a substantially half value, close to $3.10^{-11}$ J for a diameter d of the antenna 102 of 6 mm.

In FIG. 3B, it can be observed that the energy E stored in useless region 108 decreases by a factor substantially equal to 3, from $2.10^{-9}$ J to 6, $4.10^{-10}$ J, when the diameter of antenna 102 increases from 1 to 6 mm.

As shown in FIG. 3B, an increase in the diameter of the antenna causes a decrease in the volume of useless region 108, that is, a decrease in the quantity of useless plasma likely to deteriorate antenna 102. Further, as shown in FIG. 3A, useless region 106 contains a substantially constant quantity of useful plasma for diameters of antenna 102 approximately in the range from 1 to 3 mm.

An advantageous diameter of antenna 102 thus is a diameter which enables to keep as large a volume as possible of useful region 106 while reducing as much as possible the volume of useless region 108.

The inventors have thus determined that an advantageous diameter of the antenna is approximately 3 mm, for example, in the range from 2.5 to 3.3 mm, for an inner diameter of plasma chamber 100 of 10 mm. This corresponds to a diameter of a plasma source in the range from one quarter to one third of the inner diameter of the plasma chamber.

Figure 4:
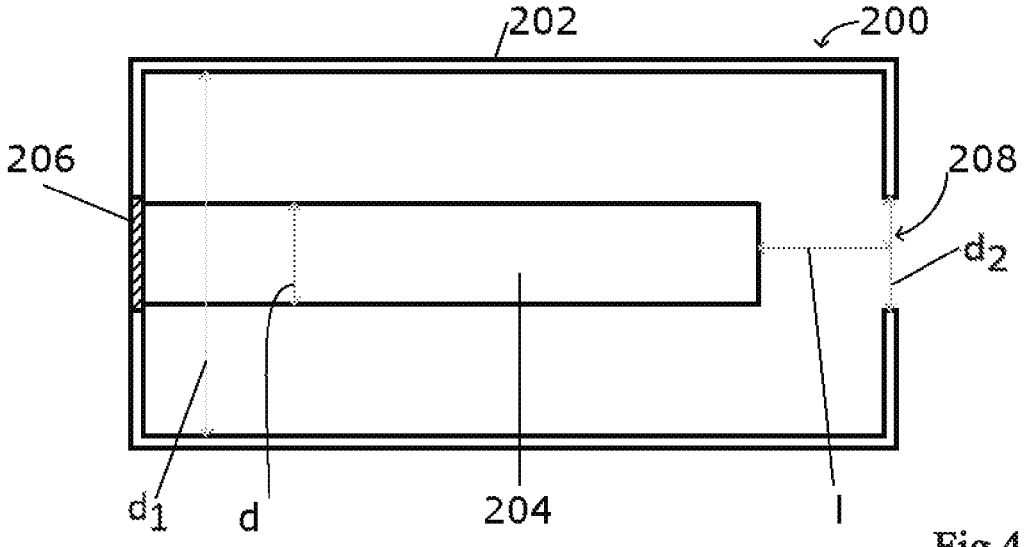
FIG. 4 is a simplified front view of an embodiment of a plasma source.

FIG. 4 is a simplified cross-section view of an embodiment of a plasma chamber 200. Plasma chamber 200 comprises a cylindrical enclosure 202. A quarter wave antenna 204 is arranged in enclosure 202. The base of antenna 204 is isolated from the enclosure by an isolator 206. Enclosure 202 comprises an opening 208 opposite the end of antenna 204. Opening 208 is, in this example, a circular opening. Opening 208 may also be an extraction grid. The inner diameter $d_1$ of the enclosure is 10 mm in this example. As previously determined, an optimal value of diameter d of antenna 204 is in the range from one quarter to one third of inner diameter $d_1$ of the enclosure, that is, approximately from 2.5 to 3.3 mm. Distance l between the end of antenna 204 and opening 208 has a value for example in the range from ⅔ to ⅝ of the diameter of antenna 204, that is, here in the range from 1.5 to 5.5 mm. Similarly, diameter $d_2$ of opening 208 in the example of FIG. 4 has a diameter approximately equal to diameter d of antenna 208, for example, in the range from ⅘ to ⅚ of diameter d of antenna 204.

Specific embodiments have been described. Various alterations, modifications, and improvements will readily occur to those skilled in the art. In particular, the inner diameter $d_1$ of the plasma chamber is here described as having a 10-mm value. This diameter may be selected differently.

Further, the diameter of opening 208 may vary between 1 μm and inner diameter $d_1$ of the enclosure.

Such plasma sources may be associated to form an extended plasma source.

The invention claimed is:

1. A plasma source comprising a quarter wave antenna located in a cylindrical enclosure provided with an opening opposite the end of the antenna, wherein:

the diameter (d) of the antenna is in the range from one third to one quarter of the inner diameter ($d_1$) of the enclosure, the distance (l) between the end of the antenna and the opening is in the range from ⅔ to ⅝ of the diameter (d) of the antenna.

2. The plasma source of claim 1, wherein the inner diameter ($d_1$) of the enclosure is in the order of 10 mm.

3. The plasma source of claim 2, wherein the inner diameter ($d_1$) of the enclosure is 10 mm, the diameter (d) of the antenna is in the range from 2.5 to 3.3 mm, and the distance (l) between the end of the antenna and the opening is in the range from 1.5 to 5.5 mm.

4. The plasma source of claim 3, wherein the opening is a circular opening having a diameter in the range from 1 μm to the inner diameter ($d_1$) of the enclosure.

5. The plasma source of claim 1, wherein the opening is a circular opening having a diameter in the range from 1 μm to the inner diameter ($d_1$) of the enclosure.

6. The plasma source of claim 1, wherein the opening is an extraction grid.

7. The plasma source of claim 1, wherein the excitation frequency of the antenna is 2.45 GHz.

8. An extensive plasma source comprising an assembly of plasma sources of claim 1 arranged side by side.

* * * * *